US008347965B2

(12) United States Patent
Spence et al.

(10) Patent No.: US 8,347,965 B2
(45) Date of Patent: Jan. 8, 2013

(54) APPARATUS AND METHOD FOR CREATING PRESSURE PULSES IN A WELLBORE

(75) Inventors: Jeffrey W. Spence, Calgary (CA); James K. Gray, Dewinton (CA); Bailey T. Epp, Airdrie (CA); Alberto Martinez, Calgary (CA); Liguo Zhou, Calgary (CA)

(73) Assignee: Sanjel Corporation, Calgary (CA)

( * ) Notice: Subject to any disclaimer, the term of this patent is extended or adjusted under 35 U.S.C. 154(b) by 192 days.

(21) Appl. No.: 12/646,826

(22) Filed: Dec. 23, 2009

(65) Prior Publication Data

US 2011/0108276 A1 May 12, 2011

Related U.S. Application Data

(60) Provisional application No. 61/259,952, filed on Nov. 10, 2009.

(51) Int. Cl.
*E21B 43/26* (2006.01)
*E21B 28/00* (2006.01)
*E21B 34/06* (2006.01)

(52) U.S. Cl. ..... 166/308.1; 166/153; 166/177.5; 166/202; 166/318; 166/329; 166/373

(58) Field of Classification Search ..... 166/308.1, 166/373, 386, 318, 329, 383, 177.5, 177.1, 166/169, 202, 193, 195, 180, 153
See application file for complete search history.

(56) References Cited

U.S. PATENT DOCUMENTS

| | | | | | |
|---|---|---|---|---|---|
| 3,066,734 | A | * | 12/1962 | Meiklejohn | 166/283 |
| 3,251,416 | A | * | 5/1966 | Kiel | 166/312 |
| 3,268,004 | A | * | 8/1966 | Kiel | 166/106 |
| 3,933,205 | A | | 1/1976 | Kiel | |
| 3,999,607 | A | | 12/1976 | Pennington et al. | |
| 4,434,848 | A | | 3/1984 | Smith | |
| 4,512,405 | A | | 4/1985 | Sweatman | |
| 4,569,394 | A | | 2/1986 | Sweatman et al. | |
| 4,905,778 | A | * | 3/1990 | Jurgens | 175/232 |
| 5,143,156 | A | | 9/1992 | Bromley | |
| 5,146,992 | A | * | 9/1992 | Baugh | 166/383 |
| 5,228,510 | A | | 7/1993 | Jennings, Jr. et al. | |

(Continued)

FOREIGN PATENT DOCUMENTS

CA 2471559 12/2004

(Continued)

OTHER PUBLICATIONS

Cleat Characterisation, Imperial College London, presentation prior to Jun. 2, 2005.

(Continued)

*Primary Examiner* — Jennifer H Gay
(74) *Attorney, Agent, or Firm* — Bennett Jones LLP

(57) ABSTRACT

An apparatus for wellbore fluid treatment having a body with a lower end, an upper end, an exterior surface and an interior surface defining a long bore open at the upper end, an outlet port spaced from the upper end, and a die in the long bore between the upper end and the outlet port. The outlet port permits the communication of fluids between the long bore and the exterior surface. The die is substantially immovable within the long bore and has an inner open diameter in which a plug is landable to create a seal in the long bore before passing through the inner open diameter.

55 Claims, 6 Drawing Sheets

U.S. PATENT DOCUMENTS

| | | | | |
|---|---|---|---|---|
| 5,249,627 | A | 10/1993 | Harms et al. | |
| 5,305,829 | A | 4/1994 | Kumar | |
| 5,390,741 | A | 2/1995 | Payton et al. | |
| 5,531,274 | A | 7/1996 | Bienvenu, Jr. | |
| 5,695,009 | A * | 12/1997 | Hipp | 166/196 |
| 5,797,454 | A * | 8/1998 | Hipp | 166/196 |
| 5,836,393 | A * | 11/1998 | Johnson | 166/308.1 |
| 5,883,053 | A | 3/1999 | Tudor | |
| 5,908,267 | A | 6/1999 | Schuring et al. | |
| 6,059,034 | A | 5/2000 | Rickards et al. | |
| 6,283,212 | B1 | 9/2001 | Hinkel et al. | |
| 6,729,409 | B1 | 5/2004 | Gupta et al. | |
| 6,877,566 | B2 | 4/2005 | Selinger et al. | |
| 7,387,165 | B2 * | 6/2008 | Lopez de Cardenas et al. | 166/313 |
| 7,405,998 | B2 * | 7/2008 | Webb et al. | 367/84 |
| 7,503,392 | B2 * | 3/2009 | King et al. | 166/373 |
| 7,559,373 | B2 | 7/2009 | Jackson et al. | |
| 7,681,650 | B2 * | 3/2010 | Telfer et al. | 166/386 |
| 7,980,313 | B2 * | 7/2011 | Barbee, Jr. | 166/325 |
| 2002/0195246 | A1 | 12/2002 | Davidson | |
| 2004/0011522 | A1 * | 1/2004 | Ivannikov et al. | 166/177.6 |
| 2004/0011566 | A1 * | 1/2004 | Lee | 175/317 |
| 2004/0262016 | A1 * | 12/2004 | Farquhar | 166/386 |
| 2006/0124310 | A1 * | 6/2006 | Lopez de Cardenas et al. | 166/313 |
| 2006/0272821 | A1 * | 12/2006 | Webb et al. | 166/305.1 |
| 2007/0000666 | A1 | 1/2007 | Vozniak et al. | |
| 2007/0023184 | A1 | 2/2007 | Jackson et al. | |
| 2007/0272411 | A1 * | 11/2007 | Lopez De Cardenas et al. | 166/305.1 |
| 2008/0302538 | A1 | 12/2008 | Hofman | |
| 2009/0008083 | A1 | 1/2009 | Themig et al. | |
| 2009/0008098 | A1 * | 1/2009 | Barbee, Jr. | 166/325 |
| 2009/0044949 | A1 * | 2/2009 | King et al. | 166/332.4 |
| 2009/0056934 | A1 | 3/2009 | Xu | |
| 2009/0126933 | A1 * | 5/2009 | Telfer | 166/301 |
| 2009/0159289 | A1 | 6/2009 | Avant et al. | |
| 2009/0308614 | A1 * | 12/2009 | Sanchez et al. | 166/328 |
| 2010/0132954 | A1 * | 6/2010 | Telfer | 166/373 |
| 2010/0252281 | A1 * | 10/2010 | Telfer | 166/386 |
| 2011/0056692 | A1 * | 3/2011 | Lopez de Cardenas et al. | 166/305.1 |
| 2011/0061856 | A1 * | 3/2011 | Kellner et al. | 166/193 |
| 2011/0108276 | A1 * | 5/2011 | Spence et al. | 166/308.1 |
| 2011/0180274 | A1 * | 7/2011 | Wang et al. | 166/386 |
| 2011/0259610 | A1 * | 10/2011 | Shkurti et al. | 166/386 |
| 2011/0267922 | A1 * | 11/2011 | Shampine et al. | 367/25 |
| 2011/0277989 | A1 * | 11/2011 | Frazier | 166/193 |
| 2011/0290473 | A1 * | 12/2011 | Frazier | 166/135 |

FOREIGN PATENT DOCUMENTS

| | | |
|---|---|---|
| CA | 2531444 | 12/2005 |

OTHER PUBLICATIONS

John D. Campbell, Major Cleat rends in Alberta Plains Coals, Feb. 1979, p. 69, 70, CIM Bulletin, Feb. 1979, Edmonton, Alberta, Canada.

Othar M. Kiel, The Kiel Process—Reservoir Stimulation by Dendritic Fracturing, pp. 1-29, Houston, Texas, USA.

H.H. Abass, M.L. Ban Domelen and W.M. El Rabaa, Experimental Observations of Hydraulic Fracture Propagation, Society of Petroleum Engineers, Inc., Nov. 1990, p. 239-251, Ohio, USA.

R.G, Jeffrey et al., Stimulation for Methane-Gas Recovery from Coal, Aug. 1998, pp. 200-207, Wyoming, USA.

M.J. Mayerhofer et al., Proppants? We Don't Need No Proppants, 1997, pp. 457-464, Society of Petroleum Engineers, Texas, USA.

J.C. Gottschling et al., Nitrogen Gas and Sand: A New Technique for Stimulation of Devonian Shale, May 1985, pp. 901-907, Journal of Petroleum Technology.

H.H. Abass, S. Hedayati, C.M. Kim, Experimental Stimulation of Hydraulic Fracturing in Shallow Coal Seams, SPE Eastern Regional Meeting, Oct. 22-25, 1991, Oklahama, USA.

* cited by examiner

APPARATUS AND METHOD FOR CREATING PRESSURE PULSES IN A WELLBORE

FIELD

The present invention relates to an apparatus relating to oil and gas wells.

BACKGROUND

The current state of the art in fracturing subterranean formations of oil and gas deposits can include a single, multiple or continuous phases of increased fracturing fluid pressure to cause dilations in said formations. Dilations formed in formations can precipitate increased production of the oil and gas resources.

In the applicant's previous issued U.S. Pat. No. 7,559,373 and published application US 2007/0023184, published Feb. 1, 2007, it has been shown that applying repeated pressure pulses of fluid may enhance the formation of formation dilations and may in fact cause both radial and dendritic dilations in targeted formations. However, achieving these pressure pulses requires additional time and costs associated with shutting down and starting up pump sources to permit pressure dissipation within the well bore.

SUMMARY

In accordance with a broad aspect of the present invention there is provided an apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; and, a die in the long bore between the upper end and the outlet port, the die being substantially immovable within the long bore and having an inner open diameter in which a plug can land to create a seal in the long bore before passing through the inner open diameter.

In accordance with another broad aspect of the present invention creating pressure pulses for the treatment of a target formation, the method comprising: running into a wellbore with an apparatus to position it proximal to a target formation, the apparatus including: a body with a lower end, an upper end, an exterior surface and an interior surface defining a long bore open at the upper end; and an outlet port spaced from the upper end, the outlet port permitting the communication of fluids between the long bore and the exterior surface; providing a fluid path from surface to the outlet port; providing a die in the fluid path, the die having an inner open diameter; creating a pressure seal above and below the outlet port in an annulus immediately surrounding the exterior surface; introducing fluids into the long bore so that the fluids exit the outlet port and are directed at the target formation; launching a plug to land in and seal against the die to stop fluid flow to the outlet port; and, increasing the pressure above the die so that the plug passes through the die causing an instantaneous increase in pressure flowing through the outlet port into contact with the target formation.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

DESCRIPTION OF DRAWINGS

Referring to the drawings, several aspects of the present invention are illustrated by way of example, and not by way of limitation, in detail in the figures, wherein.

DETAILED DESCRIPTION

Figure 1:
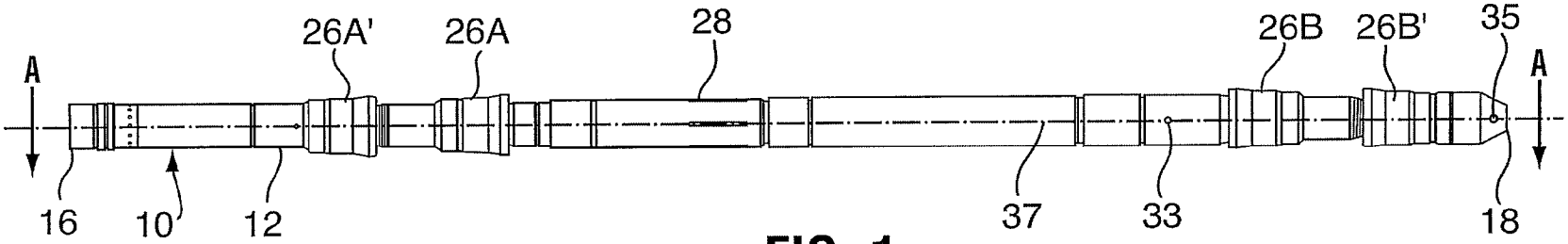
FIG. 1 is a side view of an apparatus according to an aspect of the invention.

The detailed description set forth below in connection with the appended drawings is intended as a description of the present invention and is not intended to represent the only embodiments contemplated by the inventor. The detailed description includes specific details for the purposes of providing a comprehensive understanding of the present invention. However, it will be apparent to those skilled in the art that the present invention may be practiced without these specific details.

By way of orientation, the apparatus described herein relates to the oil and gas industry, specifically oil and gas wells. As such, the terms "above" or "up hole" and "below" or "downhole" will be used as reference to certain aspects of the apparatus. Unless otherwise specified, "above" and "up hole" will refer to the direction closest to the surface of a well bore along the longitudinal axis of the apparatus. The terms "below" and "downhole" will refer to the longitudinal axial direction furthest from the surface.

An apparatus has been invented that allows pressure pulsing of a flow of fluid. The apparatus includes a tubular device that can be positioned in an area of interest, such as in a fluid flow path at surface or substantially adjacent or suitably proximate to a subterranean target formation and can act as a conduit through which fluid can pass to reach the target formation. The apparatus includes a die in the conduit which can catch a plug introduced from upstream of the conduit to create a seal in the conduit to act against fluid flow through the conduit. As such, by launching a plug, fluid flow to the formation can be stopped. The plug and/or die are formed such that the plug can eventually be removed from the die to again open the conduit to fluid flow. As such, the apparatus can be used to create a pressure pulse wherein fluid communication to the target formation can be started, stopped and started again. In so doing, the fluid flow to the apparatus may be continued but fluid communication through the apparatus to the target formation can be pulsed.

In one embodiment of the invention there is an apparatus to facilitate the recovery of well bore fluids. With reference to the figures, an apparatus 10 is shown. The apparatus 10 has a body with an exterior surface 12, a long bore 20 defined by an interior surface 14, an upper end 16, and a lower end 18. Upper end 16 is formed for connection to a string for positioning in a fluid line either at surface or within the well. The string may be formed of various materials such as a substantially continuous material, such as coiled tubing, surface lines and pipes, or interconnected tubulars. Long bore 20 extends into the body from upper end 16 but does not open at lower end 18. An end wall may be formed or inserted to limit the length of bore 20 through end 18. As will be appreciated and is common in oilfield tools, the apparatus may be formed of a plurality of interconnected units (see for example FIGS. 3 and 4), such units may be connected by methods common in the oil and gas industry so that when connected there is a substantial pressure and fluid seal that can withstand the extreme pressure fluctuations and other rigors that are commonplace in an oil and gas well environment. As an option, pup joints or other downhole tool extension devices may be introduced between sections of apparatus 10 to increase the axial length of the apparatus, as needed.

The apparatus 10 may be inserted into a wellbore, such as for production of hydrocarbons, that may or may not be lined and may be in any orientation: horizontal, vertical, non-vertical, etc. Regardless of the presence of a liner, it is to be understood herein that there will be an open area, an annulus 104 that circumferentially extends between exterior surface 12 and an outer face 108. The outer surface 108 may be the inner wall of the liner, such as casing inner surface, or the exposed wall of the borehole. If necessary or desired, the outer face 108 may be perforated at the level of a target formation 100 by methods known to those skilled in the arts of oil and gas well operations.

Along the longitudinal axis of the apparatus 10 there may be one or more fluid outlet ports 28. The ports 28 may include openings, slots, apertures, perforations or holes which provide fluid communication from the long bore 20, to exterior surface 12 of the apparatus 10. In use, the ports 28 may be positioned in fluid communication with the target formation 100 so that when any fluid is driven down the long bore 20, the fluid can escape the ports 28 and come into contact with the formation to treat it.

In one aspect there may be a die 22 within the long bore 20 above the ports 28. The die 22 may effectively restrict the inner diameter of the long bore 20. Die 22 separates the long bore 20 into an upper section 20A, between upper end 14 and the die, and a lower section 20B. For example, die 22 may be formed as a gradual or abrupt constriction for example, as a frustoconical form, a shoulder, a return or other constriction. Die 22 is positioned between the upper end and ports 28 and may be selected to remain clear of, unable to move to block off, ports 28. In one embodiment, die 22 may be fixed in one position within the long bore 20. Die 22 may be an element that is constructed as part of the tool body or may be a formed as separate unit installed in the longbore to forming part of the apparatus. By employing a die that is separate, but positionable in the tool, the die can be, inter-changeable so that it can be replaced and/or dies having different properties, such as for example IDs, surface treatments or materials, may be selectably employed. Regardless, however, once installed or formed and readied for use, the die 22 remains in the tool in a non-blocking position, for example above ports 28. In one embodiment, when installed die 22 is substantially fixed against movement along the long bore in either direction upwardly or downwardly.

The die 22 can have an inner open diameter 24 such that fluids may pass therethrough. As will be described in further detail below, however, a seal can be formed across die 22 so that fluid flow may be substantially prevented from the upper end 16 to the lower end 18. For example, a plug 30 may be employed to land in and seal against die 22, thus die 22 acts as a seat to stop fluid flow. Plug 30 may be selected to substantially create a seal against fluid flow from the upper section 20A, past the seal created by plug 30 when it is positioned in die 22, to the lower section 20B. However, any seal may be temporary, so that the die may be again opened to fluid flow. In particular, plug 30 may be selected to act temporarily in the die. In one embodiment, for example, die 22 and plug 30 may be selected to work together such that the plug can be forced by fluid pressure to pass through the die from the upper end of the die through the lower end of the die. As such, plug 30 may create a substantial seal across the die while it is in position on or passing through the die, but the die will be opened to fluid flow again once the plug is expelled out the lower end of the die.

Figure 3:
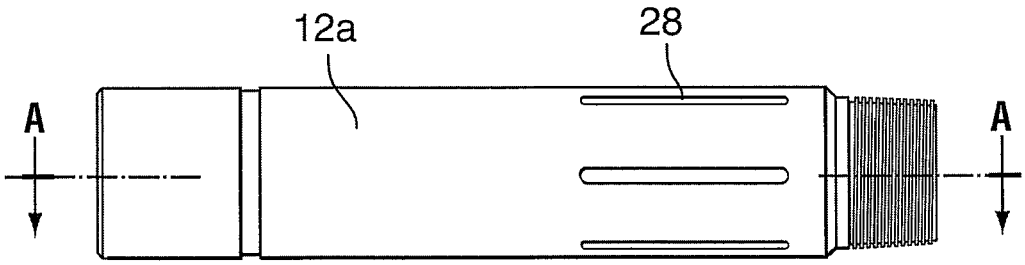
FIG. 3 is a side view of a die useful in an apparatus according to the invention.
Figure 4:
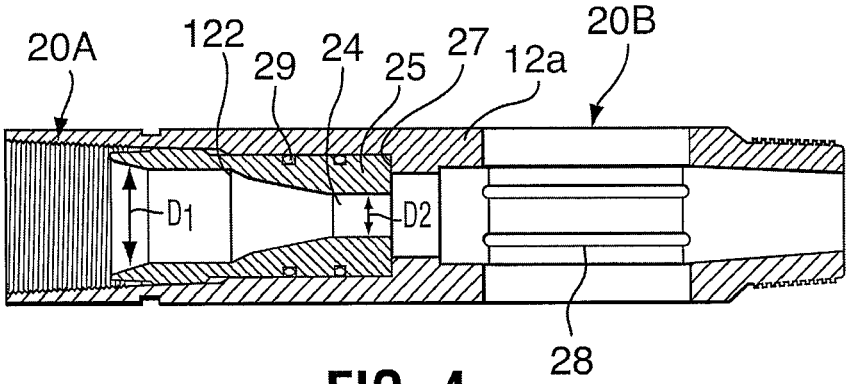
FIG. 4 is a cross section view through line A-A of FIG. 3.

As shown in FIGS. 3 and 4, in one embodiment the tool die may be formed by an installable component 25 including a die 122 formed on an inner surface thereof. The installable component may be sized to fit into a body section 12*a* defining a portion of long bore 20A. The component may be set against a shoulder 27 in the long bore that prevents the component from being moved toward outlet ports 28. Seals 29 may be installed between the component and the inner surface defining long bore 20A to prevent fluid from bypassing about the component. The die 122 in this illustrated embodiment is formed frustoconically such that an upper end diameter, shown at D1, gradually tapers to a lower end diameter D2 (D1>D2). The tool die, being formed as an installable component 25, permits the die to be replaced for the purposes of repair, inner diameter shape and size selection, material selection, surface treatment selection, etc.

Figure 10:
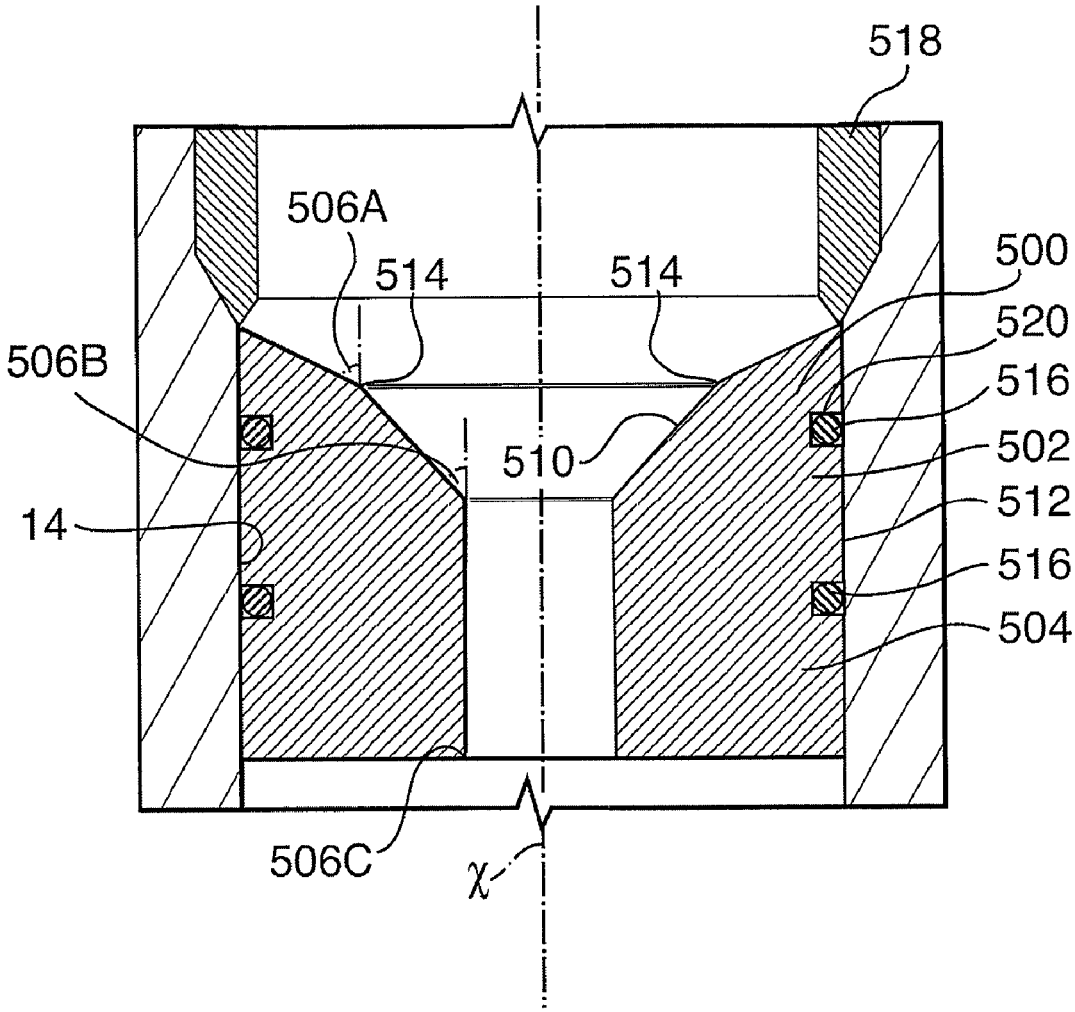
FIG. 10 is a schematic side view of another embodiment of a die.

In one embodiment, as shown in FIG. 10, the die, whether it be formed integral to the tool body or on an insertable component, as shown, may comprise three sections defining the open inner diameter D. The first section may be termed a directional section 500 which may guide the plug into the die. The second section, which is below directional section 500, may be termed a preparation section 502. The third section, which is below preparation section 502, may be termed an extrusion section 504. In the illustrated embodiment, the first, second and third sections are each positioned adjacent the next such that the first transitions into the second and the second into the third. Each section of the die may have an upper ID of different diameter and the ID of each section may taper at a different tapering angle 506A, 506B, or 506C from its upper end to its lower end. With reference to FIG. 10, tapering angles 506A, 506B and 506C are formed by reference to center axis x of the die 512. For example, the ID of the directional section may decrease corresponding to tapering angle 506A, which in one embodiment may be 20 to 40 degrees. The ID of the preparation section may decrease corresponding to tapering angle 506B, which in one embodiment tapering angle 506B may be in a range from 3 to 20 degrees and tapering angle 506C may be in a range from −5 to 10 degrees. The ID of the extrusion section may decrease corresponding to tapering angle 506C. Relative to center axis x, angle 506A will be larger than angle 506B and angle 506B will be larger than angle 506C, which may be substantially parallel to the center axis x.

Further, transition point 514 between each section may be radiused to eliminate sharpened surfaces and, thereby, decrease shearing effects on the plug when it passes through the die sections. Decreasing shear effects on the plug may decrease the potential for plug material to become deposited on the inner surface of the die. Deposition of plug material on the ID of the die, for example, the preparation or extrusion sections may variably decrease the IDs of these sections, which may influence the pressures required to deform the plug (or die as the case may be).

The length of extrusion section 504 may be substantially similar to the length of an extruded plug. This feature provides the benefit of decreasing the reverse circulation pressure, as described further below, required to remove a plug from the die upwards, in the event that the plug does not completely extrude downwards. Further, the length of the extrusion section may provide control of the velocity that an extruded plug will leave the die to possibly mitigate any damage to the plug or other downhole aspects of the apparatus.

In another embodiment of the apparatus, at least a portion of the inner surface of the die 510 may be a high grade, polished and/or low friction finish so as to decrease friction and facilitate the movement of the plug from the directional through to the extrusion section.

As discussed further below, where die is formed on an installable component, as shown, reverse circulation flow or production fluid pressure may exert forces that tend to drive the die uphole. Such uphole movement of the die may cause damage to the apparatus, the string above the apparatus and possibly equipment at surface. In another embodiment the die may have an OD that is larger than the ID of a section uphole from the die. For example, in one embodiment a spacer 518 may be installed in the long bore above the tool. Alternately, a shoulder may be formed in long bore or by threaded connections between body parts. In the event of the die being moveable within the long bore, the provisiona of a restricted ID uphole from the die may prevent the die from substantially moving uphole.

Also as shown in FIG. 10, there may be at least one gland 520 that contains at least one sealing member 516. The sealing members may ensure a pressure seal is maintained between the outer surface of the die and interior surface 14 so that substantially no fluid may be diverted around the die when a plug is landed therein.

Plugs 30 can be balls, darts, etc. that can be introduced to the well, possibly by way of fluid lines or other access points above the apparatus 10, for example, at the wellhead, to arrive at the long bore 20 by gravity, fluid conveyance, etc. as will be appreciated by those skilled in the art. Plugs 30 can be designed so that they will travel down the long bore 20, either by gravity or with the assistance of well bore fluids, for example in one embodiment being driven by fluid force generated by pumps 40 on the surface. In one embodiment, plug 30 may pass through the long bore until it lands on the die 22. When plug 30 lands against the die 22, the plug 30 may come to rest within the inner open diameter D and bear against the die to substantially form a seal against fluid flow therepast. In effect, the seal can block any fluid pressure from passing from upper section 20A above the die 22 to the lower section 20B. Of course, many seals are not perfect, as will be appreciated. As such, although a complete seal is desired, it may not be achievable and small leaks may occur. Fluid communication between the upper section 20A and the lower section and, as such, fluid communication to the target formation 100 can be substantially stopped, when desired, by the operator by introducing a plug 30 into the well to land in die 22. When the plug lands on the die, fluid flow to the target formation may be stopped substantially immediately.

The seal may persist as long as the plug remains sealed against the die. As one can appreciate, removal of plug 30 from the die 22 causes the seal to be lost and fluid communication re-established between upper section 20A, lower section 20B and target formation 100. In one embodiment, plug 30 may be removed from the die 22 by forcing the plug 30 through inner open diameter D. For example, plug 30 may be designed so that by pumping of well bore fluids into upper section 20A, a shear pressure is achieved above the plug 30 in the die 22 and the shear pressure may cause the plug 30 to deform and be forced to pass through the inner open diameter 24 of the die 22.

The shear pressure that is required to move a plug through a die may be determined by selecting characteristics of the plug and/or die. The die 22 and the plugs 30 may possibly be selected to tailor the apparatus to a given circumstance. For example, consideration may be given to: the size and material properties of plugs 30 and/or size, shape, surface properties and material properties of inner open diameter D to determine shear pressure required to remove a plug from the die. For example, dies with different sizes of inner open diameter D may be used and/or different sized plugs 30 may be used as each circumstance may require. As another example, the ability of the plug and/or the die to deform may affect the pressure required to move the plug through the die.

For example, the more deformable the plug, generally the lower pressure that is required to be built up to move the plug through the die. Young's Modulus of Elasticity provides a helpful standard for determining the deformability of various materials for selecting plug properties. For example, plugs may be made of materials with a wide range of modulus of elasticity, such as: rubber (about 1,500 psi) to ceramic (about 5,700,000 psi). For example, in one embodiment, the range of useful modulus of elasticity could fall between 1,500 psi (rubber) and 600,000 psi (Torlon®, a polyamide-imide) The material selection may depend on the material of the die. For example, where the die is formed of substantially undeformable material such as steel, the plug may be formed of relatively more deformable materials such as having a modulus of elasticity between 1500 psi to 600,000 psi and possibly a range between 195,000 psi and 450,000 psi.

In another embodiment, plug 30 may be made of a material that is substantially non-deformable selecting for example, from materials as described above with respect to the plug. In this embodiment, the die may be selected to deform under the fluid pressure from above to allow the plug to be forced through the die. For example, a substantially non-deformable plug may come to rest in the substantially deformable die. A temporary seal will be created and the pressure in upper section 20A can be increased until the substantially deformable die deforms and the plug passes therethrough. In such an embodiment, the plug may be made substantially of steel (modulus of elasticity of 30,000,000 psi) or other substantially non-deformable materials. The die may be made of deformable materials, so that the die will deform under the working pressure ranges of the tool, in a given working circumstance. Further, the die may be comprised of materials that are substantially resilient, so that a given die may be deformed but resume its shape multiple times.

As another option, the plugs and/or the dies may be manufactured as composites of different materials. Such an approach may provide the operator a greater number of choices for selecting the pressure required to dislodge the plug from the die. For a given formation, the skilled operator may prefer to pulse a pressure downhole that does not correspond precisely with any single material die or plug. A composite plug and/or die, for example a plug including a rubber exterior with a ceramic core, may offer a modulus of elasticity that lies between the modulus of elasticity of the two individual materials and that does not correspond to any other known or appropriate material's modulus of elasticity.

Upon the loss of the seal the fluid pressure will immediately and instantaneously flow through the inner open diameter D and out the ports 28, through stimulation chamber 112 and into contact with the target formation 100. Thus an instantaneous pulse of fluid pressure may be directed at the target formation 100 to treat it, possibly fracturing the formation and possibly causing dendritic fractures. The instantaneous pulse of fluid may be at a higher pressure than if surface pumps 40 continued to pump fluids into the wellbore through open inner diameter D. For example, pressure above plug 30 may build up while the plug remains in the die and may be released in a short period of time once the plug passes through the die, creating a sudden high pressure pulse at the formation.

On the exterior surface 12 of the tool, there may be one or more sealing members to direct and contain fluid passing through ports 28. The sealing member or members can form a pressure seal within the annulus 104 between exterior surface 12 and outer face 108 to control the flow of fluid through the annulus. In one embodiment, at least one sealing member is positioned above the ports 28, between ports 28 and the upper end 16 and at least one sealing member is positioned below the ports 28, which is towards to the lower end 18. As one skilled in the art can appreciate, there are numerous different types of sealing members that are appropriate for downhole conditions, such as expandable or inflatable packers, elastomeric rings, cups, etc. In one embodiment, the sealing members include one or more cup packers 26A and 26B. Cup packers 26A and 26B may circumferentially extend around the exterior surface 12 and be sized, depending on tool size vs. wellbore diameter, to make contact with outer face 108. Cup packers 26A and 26B are elastomeric and may create a pressure seal, for example, by pressure differential or other methods known to those skilled in the art, to form a fluid pressure seal within annulus 104.

In the illustrated embodiment, there is at least one cup packer on either side of (above and below) the ports. For example, a cup packer 26A may encircle the tool body and be positioned between upper end 16 and ports 28 and a cup packer 26B may encircle the tool body between lower end 18 and ports 28. As such, cup packer 26A can be positioned above the target formation and cup packer 26B can be positioned below the target formation. Cup packer 26A may be oriented to create a pressure seal so that a greater pressure can be maintained therebelow and cup packer 26B may be oriented to create a pressure seal so that a greater pressure can be maintained thereabove. Cup packers 26A, 26B may, therefore, form a pressure seal above and below the ports 28 so that when any fluid or pressure is driven down the long bore 20, the fluid or pressure escapes the ports 28 and may be focused between the cup packers 26A and 26B, for example the fluid may be directed at the target formation. The area of the annulus 104 between cup packer 26A and cup packer 26B may be referred to as a stimulation chamber 112. In one option, the distance between packer cup 26A and packer cup 26B, and hence the length of the stimulation chamber 112, can be selected, by the insertion of pup joints or other well tubing extensions.

By use of a seal that permits fluid flow in one direction therepast, but not in the other, such as a cup packer 26A, if desired, fluid may be pumped into the wellbore, in reverse, down through the annulus 104 and may pass packer 26A into the stimulation chamber 112. Due to the orientation of cup packer 26B below the ports, the fluid may be diverted into port 28 to clear any debris from the stimulation chamber 112. Further, should a plug become stuck within the die, reverse circulation pressure may be used to force the plug upwards through the extrusion section of the die towards the surface.

Alternatively or in addition, the orientation of the lower seal may be selected to provide a means of releasing any pressure that may build up below the apparatus. For example, pressure may flow upwards past cup packer 26B, into the stimulation chamber, through the ports and up the long bore towards the surface. The release of such downhole pressure below the apparatus may, for example, decrease the level of shear pressure in the upper portion of the tool that is required to deform the plug through the die. For example, if pressures are allowed to build up below die 22 including below a lower seal, that pressure may increase the pressure needed above the die to achieve a suitable extruding pressure differential at the die.

To provide redundancy, there may be two sets of sealing members, for example, at least one set of upper cup packers 26A, 26A' above the ports 28, towards the upper end 16 and at least one set of cup packers 26B, 26B' below the ports 28, which is towards to the lower end.

In another embodiment, pressure inflated packers may be employed in the place of cup packers. In this option, the pressure created by driving fluids through the long bore may inflate packers above the stimulation chamber. Further, a conduit may be provided that conducts pressure across the length of the stimulation chamber to communicate into and to inflate packers below the stimulation chamber. The inflatable packers may be released by a pull release when desired and can be reinflated, if desired, by landing another plug on the die and pressuring up.

A retaining area 32 may be formed in long bore 20 below die 22 and ports 28. The long bore 16 may end at the retaining area 32. The retaining area 32 may be a close-ended receptacle that may collect plugs 30 after they have been removed from the die 22. For example, when plug 30 has been introduced into the wellbore and landed on the die 22 a seal is formed. By continuous pumping of fluids from the surface, a shear pressure may be achieved in the upper section 20A and the plug is removed from the die 22 by passing through the inner open diameter 24. By way of gravity and/or the fluid pressure behind the plug, plug 30 may land in the retaining area 32 below. Retaining area 32 may house any plug 30 that passes through the inner open diameter 24.

After extrusion of the plug through die 22, a second plug may be introduced into the long bore 16 to create a second seal. Thereafter, if surface pumps 40 continue to drive fluids down the long bore 16 pressure will build up in the upper section 20A until the shear pressure is attained. Once the shear pressure is attained the second plug will be removed from the die 22 and fall into the retaining area 32 and the second seal will be lost. As one can appreciate, if surface pumps continuously pump fluid into the long bore 20, plugs may be launched into the long bore 20 to generate downhole pressure pulses, wherein fluid pressure contacting a target formation is stopped and resumed. When any plug lands in the die 22, fluid flow to target formation 100 will stop substantially immediately and when that plug is removed from the die 22, fluid flow will instantly resume to target formation 100. The second and any further plugs may be introduced to treat the same target formation as the first plug or the tool may be moved so that the second and further plugs are introduced to treat one or more other target formations along the wellbore.

In one embodiment of the present invention, the retaining area may be sized to contain more than twenty and in some embodiments more than thirty plugs 30 such that the apparatus can remain downhole and complete a number of pressure pulses before returning to surface. The lower end of the retaining area may be rounded to cause the balls to settle together. This may tend to create a shock absorbing effect for further balls coming through the die.

It has been observed that pressure may become trapped in the plug retaining area amongst the plugs. It is possible that this is caused by small debris from the formation, such as sand or coal fines, entering the apparatus and settling within the retaining area. Said trapped pressure may pose a safety risk to operators when the tool is retrieved to the surface and as the plugs are removed from the retainer. In one embodiment, the retainer may contain a pressure-bleed off port 37 so that pressure inside the retainer may be pressure equalized prior to removing plugs from the retaining area. The pressure-bleed off port may be formed to be always open to equilibrate with its surrounding pressure, even while the tool is downhole. Alternately, the pressure-bleed off port may be normally closed with a removeable closure or valve to permit opening for pressure equalization only when it is desired. The pressure-bleed off port may extend between the retaining area and the exterior surface of the tool, opening on the exterior surface between packers 26A, 26B and at a position along the length of the retaining area between ports 28 and the lower end of the retaining area. In one embodiment, the pressure-bleed off port may be substantially located towards the middle of the retainer's length for example, relatively centrally in the middle third between the ports 28 and the lower end of the retainer. The pressure-bleed off port may present a significantly smaller opening than the ports 28 so that the treatment pressure does not tend to escape the tool through that port 37.

Port 28/plugs 30 may be designed so that any plug 30, and possibly even debris therefrom or debris from outside of the tool does not block completely or pass through the ports.

A pressure port 33 and cavity 34 may be provided in fluid communication with exterior surface 12 of the apparatus 10 between packers 26A, 26B. The cavity 34 can house various components as desired. For example, a pressure sensor and/or a pressure recorder may be housed in cavity 34 to sense and record downhole pressure, via pressure port 33. Cavity 34 may be separate from bore 20 and may be in communication with the exterior of the tool to monitor fluid pressure having undergone a pressure drop after passing out through ports 28, that fluid being in communication with the formation.

Alternatively or in addition another port 35 to a chamber 36 may be provided below lower packer 26B to house monitoring devices and record conditions downhole of the ports 28 and packers 26A and 26B. This may be useful to record pressure conditions, possibly against time and/or temperature to study the effect of pressure pulses on wellbore conditions as well as the wellbore and generally.

The lower end 18 may be formed with a rounded, bulbous or bullnose shape with an OD that is larger than the rest of the apparatus. The larger OD of the lower end may provide a means to centralize the apparatus within the wellbore to ensure there is an even distribution of forces, pressure, debris etc. acting upon all lateral sides of the apparatus throughout the annulus.

In another embodiment of the present invention there is a method for wellbore treatment. The method may include the step of selecting a well bore having a target formation 100, which for example may contain hydrocarbons of interest. Die 22 can be inserted in line with the conduit through which fluids may be passed to treat the formation. A die and a plug retainer may be installed at surface or anywhere along the lines between surface and the formation, where outlet ports provide fluid access to the formation. In one embodiment, die 22 is installed in an apparatus 10 to be positioned downhole. Apparatus 10 can be inserted into the wellbore on a string such as a tubing string, coiled tubing, etc. such that bore 20 is in fluid communication with surface and ports 28 are suitably proximate to target formation 100. Cup packers 26A and 26B, being positioned to direct and contain fluid from ports 28 to target formation 100, are set against the outer face 108 with at least a portion of the target formation positioned between the cup packers 26A, 26B.

Figure 6:
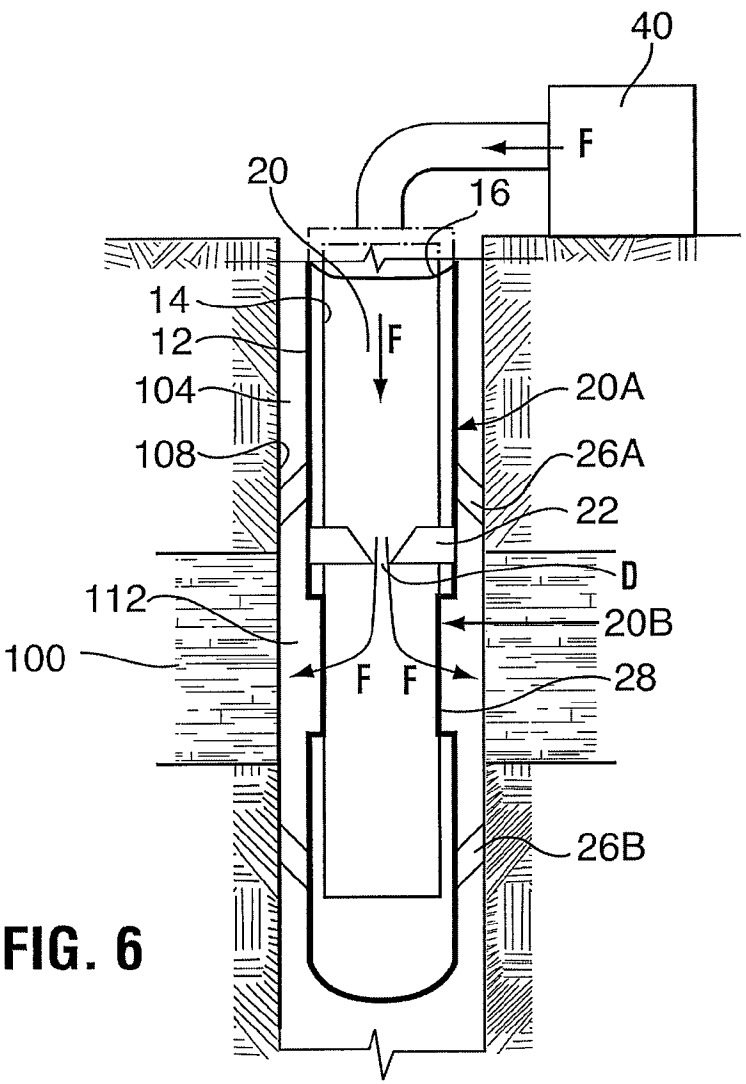

Fracturing fluid may be introduced into the well by surface pumps 40. The fracturing fluid may include a liquid, a gas or a combination thereof. In one embodiment, the fracturing fluid may include one or more of, for example, water, nitrogen gas, carbon dioxide, etc. The fluid, arrows F in FIG. 6, is communicated to and driven into the long bore 20, through the ports 28 and into the target formation 100. The flow of the fluid into the well bore may gradually increase downhole pressure. Further, at the surface the operator may introduce a proppant into the fluid to prop open or maintain any dilations in the target formation 100.

Figure 7:
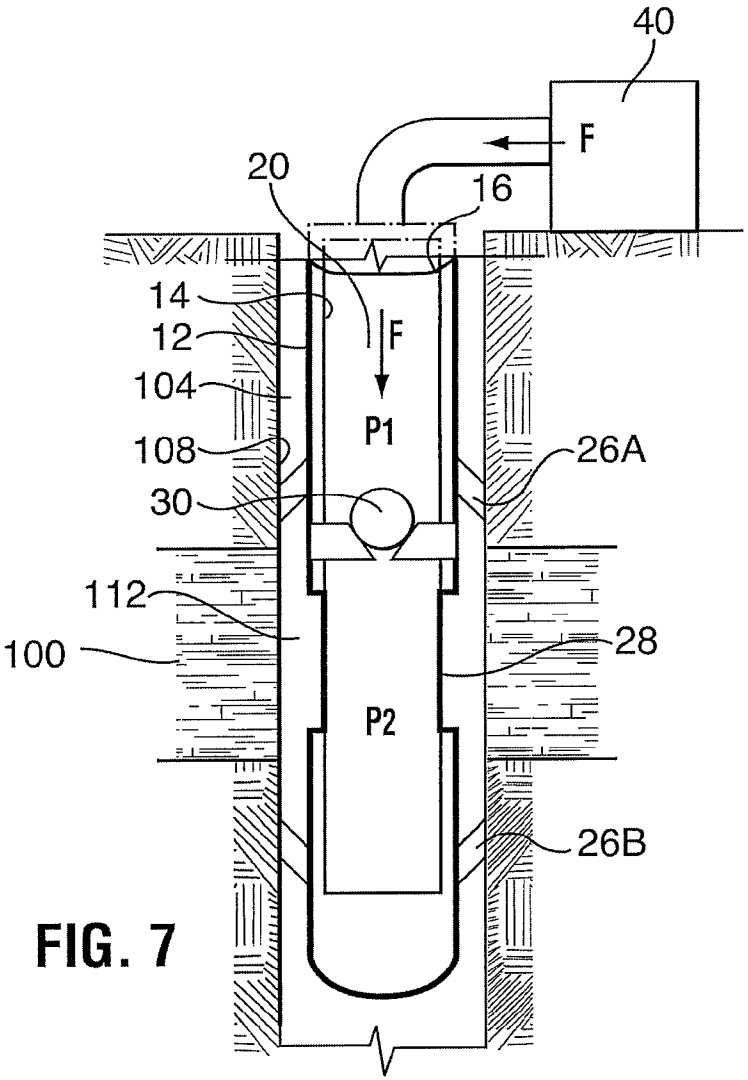
FIGS. 6, 7 and 8 are sequential schematic axial sectional views of an apparatus positioned in a well.

At a selected time, a plug 30 may be launched to arrive in long bore 20. By way of gravity and/or possibly assisted by the driving force of the pumping surface pumps 40, the first plug comes to rest in the inner open diameter D of the die 22 (FIG. 7). As the surface pumps 40 continue to pump fluid into the long bore, the first plug can form a seal so that no fluid will pass the die 22 and downhole pressure P2, for example in the lower section 20B below the die 22 and at the formation may begin to dissipate, as the fluid diffuses into the formation.

Figure 8:
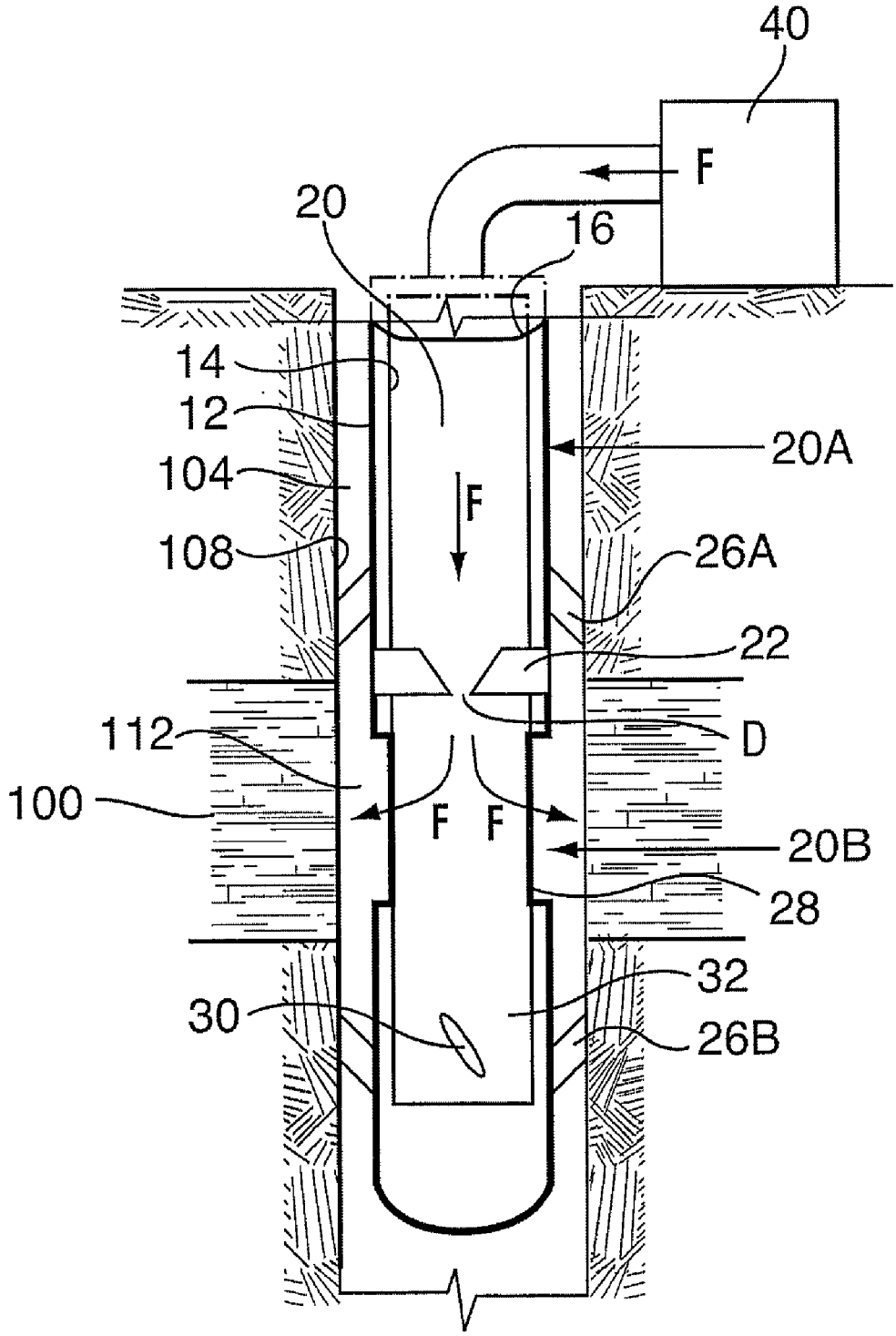

As the surface pumps 40 continue to pump fluid into the long bore, pressure will gradually increase above the seal created by plug 30 in the die 22 such that pressure P1 above the plug will be much greater than that P2 below the plug. At a specific shear pressure, the plug may begin to deform and be pushed through the inner open diameter D of the die. When the plug 30 is completely expelled, the inner open diameter D of the die will be unobstructed (FIG. 8) and there will be a substantially instantaneous increase in downhole pressure. The plug 30, now possibly deformed, will fall into the retaining area 34.

When the plug 30 has passed through the die, the flow of fluids from the upper section 20A to the lower section 20B is unobstructed and a sudden pressure pulse is communicated to the formation. An instantaneous increase in downhole pressure can be quite effective in wellbore treatment such as fracturing. In one embodiment, a sudden increase in downhole pressure, with or without an initial increase in downhole pressure and a delay which allows the target formation 100 to relax from the initial increase in downhole pressure, can cause further fracturing of the target formation 100 and may for example generate dendritic fractures. The dendritic dilations can extend perpendicularly from the radial dilations within the target formation 100. The operator can introduce further proppant into the fluid so that the radial and dendritic dilations are maintained open.

Without removing the apparatus from the formation, the operator may launch a second plug into the well bore to create another sudden pressure pulse. This may be at the same target formation or another formation uphole or downhole therefrom. The surface pumps 40 can pump fluid into the long bore 20. In a similar fashion as the first plug 30, the second plug creates a seal at the die stopping fluid flow to the formation. When the shear pressure above the plug is attained, the second plug will dislodge from the inner open diameter 24, fall into the retaining area 34 and cause a second pressure pulse caused by the substantially instantaneous increase in downhole pressure. The operator can introduce further proppant into the fluid so that the radial and dendritic dilations are maintained open.

As one can appreciate, the operator can launch one or more plugs to cause cyclic pressure pulses, including a period of time when no fluids are communicated to the formation followed by a period of time when fluid is communicated to the formation including a substantially instantaneous increase in downhole pressure. Such a method acting to treat and for example fracture the formation, creating further dilations, possibly both radial and dendritic, can be repeated until such a point that the target formation is ready for production.

Alternately or in addition, the tool can be moved within the wellbore to another formation and can be employed to communicate one or more pressure pulses to that formation by launching plugs and pumping fluids.

Because die 22 is open, fluid may be circulated or pumped through the apparatus, even at higher pressures, as desired. Pulses are generated only by dropping a plug or by manipulation of surface pumps. As such, if a formation is accessed that needs no pulse, then stimulation fluids may be introduced without a pressure pulse.

The die 22, the plugs 30 and the flow rate of fluids being pumped by surface pumps 40 may possibly be selected to tailor the apparatus to a given result. For example, consideration may be given to: the size and material properties of plugs 30; size, shape, surface properties and material properties of inner open diameter D; and pumping rates to determine the conditions, amount of time, shear pressure, pressure differential, etc, required to remove a plug from the die. This may be considered by experimentation including by reviewing data from surface pressure and/or a pressure recorder installed in the tool. This information may assist the operator in selecting the form and composition of the tool and operating conditions to either increase or decrease the amount of time that the seal in the die 22 is maintained and the pressure at which the plug will be driven through the die. For example, the longer amount of time that the seal is formed and maintained, the longer the target formation 100 may relax. The longer the target formation 100 relaxes, the more effective the instantaneous pulse of fluids may be at increasing, extending or enlarging dilations. Alternately or in addition, the more shear pressure that is required to move a plug through the die, the greater the pressure pulse that will be communicated to the formation, when the plug is finally expelled from the die.

As desired, for example, the operator may alter the amount of pressure, the time taken for the plug to extrude through the die or amplitude of a given instantaneous pressure pulse based upon the materials forming a given plug and the size of the plug. For example, with any particular die, if the operator desires to treat a formation with a relatively higher-pressure pulse, a ball made of more rigid material and/or a larger ball may be used. However, with the same die, if an operator chooses to treat a formation with a relatively lower pressure pulse a ball made of less rigid, more easily deformable, material and/or a smaller ball may be used. Smaller amplitude instantaneous pressure pulses can provide a means for efficient stimulation of the formation while conserving costly resources, when compared to higher amplitude pressure pulses. In a wellbore, formations with different geological characteristics, and therefore different stimulation requirements, may be stimulated differently for example using pulses with differing pressure conditions by the operator's selection of plugs at the surface, without tripping the apparatus back to surface. For example, a plug composed of polypropylene may be relatively more deformable and therefore displaced from the die at a lower pressure than a plug composed of polyvinylchloride. Further, a plug composed of polyvinylchloride may be relatively more deformable and therefore displaced from the die at a lower pressure as compared to a plug composed of acetal homopolymer, such as DELRIN™ acetal resin. As such, if a downhole formation requires a greater amplitude, instantaneous pressure pulse a DELRIN™ acetal resin ball may be launched into the wellbore to form a seal within the die. However, if a formation requires a smaller amplitude, instantaneous pressure pulse a polypropylene ball may be used. There may be additional reasons why an operator would elect to use a lower amplitude, instantaneous pressure pulse. For example if there are complications with downhole casing or downhole cement integrity a higher amplitude, instantaneous pressure pulse may travel around stimulation chamber 22, external to the apparatus and cause a pressure collapse of the apparatus, coiled tubing, casing etc. In such a situation, lower pressure treatments may be of interest for example. Data from one or more downhole logs may be used to provide information as to the geological characteristics of the formations within a wellbore and therefore direct the operator as to the type of ball to that may be used.

Shear pressures greater than 10 MPa, and possibly in a range of 10 MPa to 80 MPa, may be of particular interest.

As an example, with a die of a given ID size, for example 1.25 inches, an operator may launch plugs made of different materials to affect a different pressure pulse at the formation. For example, with 1.5 inch plugs, a plug made of polypropylene may create a pressure pulse of about 32 MPa, a plug made of polyvinylchloride may create a pressure pulse of about 42 MPa, a plug made of drop-cast DELRIN™ acetal resin may create a pressure pulse of about 44 MPa, a plug made of nylon may create a pressure pulse of about 51 MPa and a machined DELRIN™ acetal resin plug may create a pressure pulse of about 71 MPa.

Furthermore, utilizing the same balls through a die with a different ID, for example 1.375 inches, further pressure results may be obtained. For example, the plug made of polypropylene may create a pressure pulse of about 23 MPa, and the machined DELRIN™ acetal resin plug may create a pressure pulse of about 37 MPa.

Employing a die with three die sections, such as one shown in FIG. 10, again by way of example, the operator may employ a die with an ID of about 1 inch through the extrusion section and by utilizing 1.5 inch plugs composed of different materials a range of pressure pulses are available to the operator, such as: a plug made of polypropylene may create a pressure pulse of about 46 MPa, a plug made of polyvinylchloride may create a pressure pulse of about 70 MPa. Whereas if the operator uses the same balls and selects a die with an ID of 1.251 inches at the extrusion section, a shear pressure range of about 20 to 50 MPa can be obtained. Therefore, by using plugs created from different materials the operator may create a range of pressure pulses and by using different dies, with selectably different IDs another range of pressure pulses are available to affect on a given downhole formation.

Therefore, by using plugs created from different materials the operator may create a range of pressure pulses and by using different ball size to die ID ratios, another range of pressure pulses are available to treat a given downhole formation. The pressure results for any ball/die combination can be readily determined and recorded for use during well treatment. Similar pressure results can be obtained and recorded for deformable dies for use by an operator.

The construction properties of the plugs may influence the conditions at which they repeatably extrude through the die. For example, in one embodiment plug materials are employed that have substantial even consistency therethrough. Plugs with irregular material properties may be avoided. For example, machined plugs formed from consistent material stock may be used to avoid plugs with variable inner air or fluid pockets, as might occur by molding.

Downhole conditions, such as of pressure, temperature, etc. may be monitored through devices installed in cavities 34 and/or chamber 36.

Figure 5:
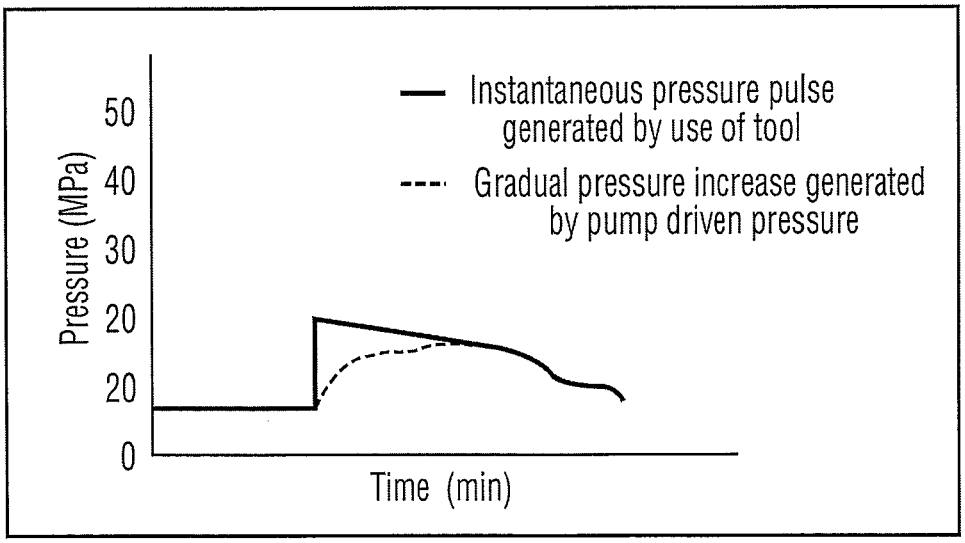
FIG. 5 is a line diagram comparing downhole pressures over time, with and without employing a method according to the present invention.

FIG. 5 illustrates a comparison of pump operation alone to increase formation pressure against a method employing a tool according to the present invention. As shown in FIG. 5, starting from an initial wellbore pressure (measured at the formation), the use of pumps alone to increase pressure downhole can cause a gradual increase such as, for example, from 5 MPa to 15 MPa over the course of one to two minutes. However, where a ball lands in the die of the apparatus, as described above, and pumps are driven to pump fluids into the well, the downhole pressure below the die can be abruptly increased, for example, from 5 MPa to over 15 MPa in less than 30 seconds, possibly in a few seconds or in a fraction of a second when the ball is finally extruded through the die. It is well understood by those skilled in the art that an initial and gradual increase in downhole pressure can cause dilation of the target formation 100. However, the abrupt, shock-type pressure change afforded by operation of the tool may increase fracture response considerably over a gradual pump driven increase.

EXAMPLE

Figure 2:
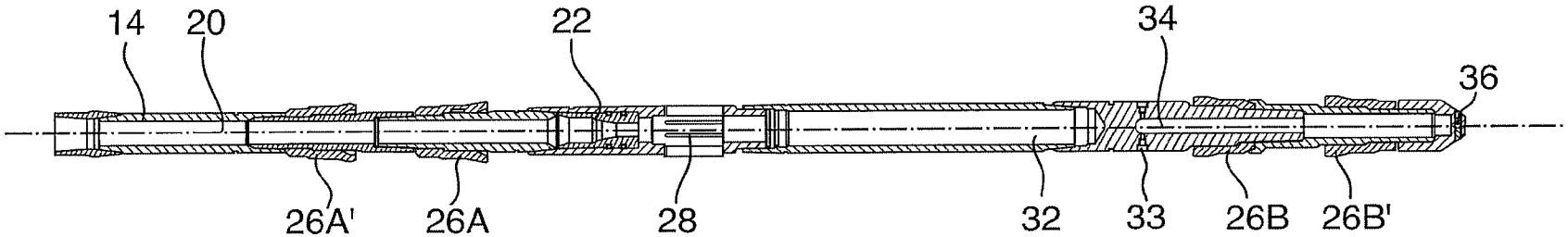
FIG. 2 is a cross sectional view through line A-A of FIG. 1.
Figure 9:
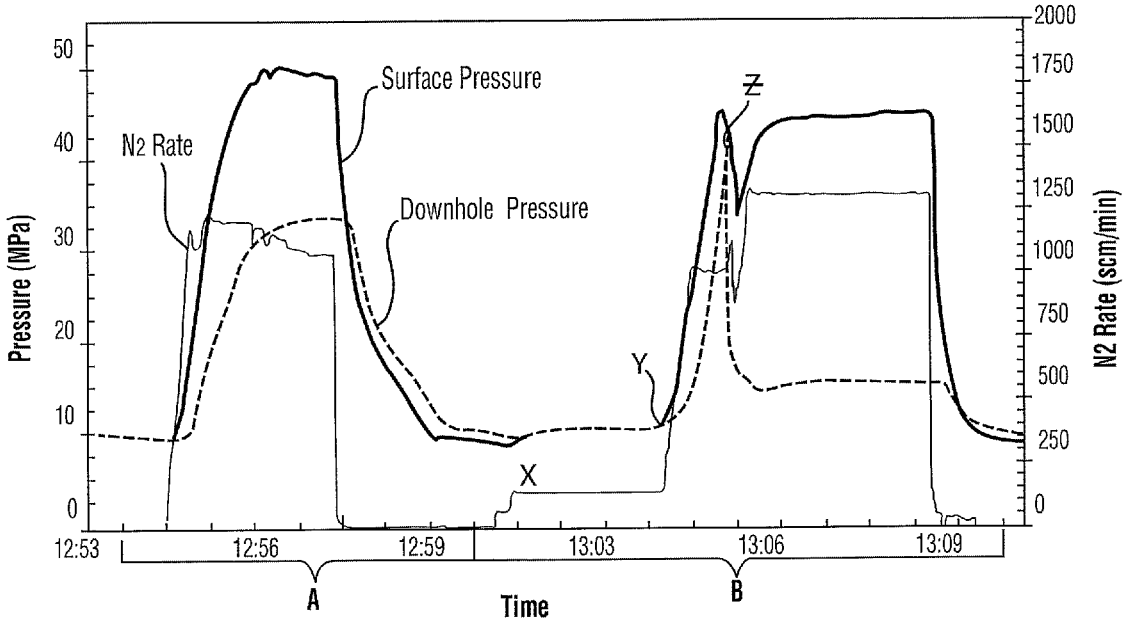
FIG. 9 is a line diagram representing example pressure (MPa) data and nitrogen flow rate (scan/min) data over time.

FIG. 9 illustrates a pressure pulse achieved with an apparatus according to the invention. The chart illustrates the pressure pulse through of pressure data (MPa) and nitrogen flow rates (scm/min) charted over time. In this example, an apparatus such as that illustrated in FIG. 2 was lowered into a wellbore, so that the ports were substantially proximate to a coal formation. The die as shown was positioned slightly uphole of the ports. The first grouping of peaks (time-frame A) are recordings of the apparatus used as an open bore stimulation tool. As the nitrogen rate is increased to a maximum of approximately 1200 scm/min, one can observe over time a gradual increase in pressure at the surface and a gradual increase in bottom hole pressure.

The second grouping of peaks (time-frame B) are recordings of the apparatus used with a plug to create a substantially instantaneous pressure pulse. A time point X, a 1.318 inch-diameter machined Delrin™ ball was launched into the wellbore. The launching of the ball was assisted by increased nitrogen flow from the surface. At point Y the ball formed a seal in the die, as reflected by extremely rapid pressure increases recorded at the surface while there is a constant rate of nitrogen flow. As surface pressure increases to a maximum of approximately 45 MPa the ball was pushed through the ID of the die. Once the ball passes the die (at point Z), there was an instantaneous increase in bottom hole pressure from 10 MPa to approximately 40 MPa was observed. Following the instantaneous pressure pulse, increased nitrogen rates have no influence on bottom hole pressure, which may be evidence that new or further fractures have been formed in the formation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. An apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; and, a die in the long bore between the upper end and the outlet port, the die being substantially immovable within the long bore and having an inner open diameter in which a plug is landable to create a seal in the long bore before passing through the inner open diameter, wherein the lower end has a pressure port to permit fluid communication from the well bore to a cavity.

2. The apparatus as in claim 1, wherein the upper end is formed so that fluid is communicable between the surface and a target formation.

3. The apparatus as in claim 1, wherein the cavity contains a pressure sensor and pressure recorder.

4. An apparatus as in claim 1, further comprising at least one upper sealing member above the outlet port and at least one lower sealing member below the outlet port.

5. An apparatus as in claim 4, wherein the at least upper one sealing members and the at least one lower sealing members are elastomeric.

6. An apparatus as in claim 5, wherein the at least one upper sealing members and the at least one lower sealing members are cup packers.

7. An apparatus as in claim 1, wherein the plug forms a seal within the inner open diameter to prevent the flow of fluids from above the die to below the die.

8. An apparatus as in claim 1, wherein the plug is deformable by increased well bore pressure and the plug is passable through the inner open diameter thereby permitting the flow of fluids from above the die to below the die.

9. The apparatus as in claim 8, wherein the upper end is formed so that fluid is communicable between the surface and a target formation.

10. The apparatus as in claim 8, wherein the cavity contains a pressure sensor and pressure recorder.

11. The apparatus as in claim 8, wherein the plug forms a seal within the inner open diameter to prevent the flow of fluids from above the die to below the die.

12. The apparatus as in claim 8, wherein the die includes an inner diameter, defined by an upper tapering section and a lower tapering section, the upper tapering section having a tapering angle, relative to a center axis, greater than a tapering angle of the lower tapering section.

13. The apparatus as in claim 8, wherein the die is formed on a replaceable component, insertable into the long bore.

14. The apparatus as in claim 8, wherein the die is formed of deformable materials.

15. An apparatus as in claim 1, wherein the die includes an inner diameter, defined by an upper tapering section and a lower tapering section, the upper tapering section having a tapering angle, relative to a center axis, greater than a tapering angle of the lower tapering section.

16. An apparatus as in claim 1, wherein the die is formed on a replaceable component, insertable into the long bore.

17. An apparatus as in claim 1, further comprising a plug retaining area, in communication with the long bore, extending away from the die, beyond the outlet port.

18. The apparatus as in claim 17, further comprising a pressure-bleed off port providing communication between the ball retaining area and the exterior surface, between the outlet port and a lower end of the ball retaining area.

19. An apparatus as in claim 1, wherein the die is formed of deformable materials.

20. A method is provided for creating pressure pulses for the treatment of a target formation, the method comprising: running into a wellbore with an apparatus to position the apparatus proximal to a target formation, the apparatus including: a body with a lower end, an upper end, an exterior surface and an interior surface defining a long bore open at the upper end; and an outlet port spaced from the upper end, the outlet port permitting the communication of fluids between the long bore and the exterior surface; providing a fluid path from surface to the outlet port; providing a die in the fluid path, the die having an inner open diameter; creating a pressure seal above and below the outlet port in an annulus immediately surrounding the exterior surface; introducing fluids into the long bore so that the fluids exit the outlet port and are directed at the target formation; launching a plug to land in and seal against the die to stop fluid flow to the outlet port; and, increasing the pressure above the die so that the plug passes through the die causing an instantaneous increase in pressure flowing through the outlet port into contact, with the target formation.

21. The method as in claim 20, wherein the pressure seals are created by way of setting at least one elastomeric sealing member.

22. The method as in claim 21, wherein the at least one elastomeric sealing member is a cup packer.

23. The method as in claim 20, further comprising launching a second plug to create a plug seal at the die.

24. The method as in claim 23, further comprising increasing the pressure above the die so that the second plug passes through the die causing a second instantaneous increase in pressure flowing through the ports into the target formation.

25. An apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; a die in the long bore between the upper end and the outlet port, the die being substantially immovable within the long bore and having an inner open diameter in which a plug is landable to create a seal in the long bore before passing through the inner open diameter; and at least one upper sealing member above the outlet port and at least one lower sealing member below the outlet port, wherein the plug is deformable by increased well bore pressure and the plug is passable through the inner open diameter thereby permitting the flow of fluids from above the die to below the die.

26. An apparatus for wellbore fluid treatment, comprising: a body with a lower end, an upper end, an exterior surface and an interior surface defining a long bore open at the upper end: an outlet port spaced from the upper end, the outlet port permitting the communication of fluids between the long bore and the exterior surface; and, a die in the long bore between the upper end and the outlet port, the die being substantially immovable within the long bore and having an inner open diameter in which a plug is landable to create a seal in the long bore before passing through the inner open diameter, wherein the plug is deformable by increased well bore pressure and the plug is passable through the inner open diameter thereby permitting the flow of fluids from above the die to below the die; and wherein the at least upper one sealing member and the at least one lower sealing member are elastomeric.

27. The apparatus as in claim 26, wherein the at least one upper sealing member and the at least one lower sealing member are cup packers.

28. An apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; a die in the long bore between the upper end and the outlet port, the die being substantially immovable within the long bore and having an inner open diameter in which a plug is landable to create a seal in the long bore before passing through the inner open diameter; and a plug retaining area, in communication with the long bore, extending away from the die, beyond the outlet port, wherein the plug is deformable by increased well bore pressure and the plug is passable through the inner open diameter thereby permitting the flow of fluids from above the die to below the die.

29. The apparatus as in claim 28, further comprising a pressure-bleed off port providing communication between the ball retaining area and the exterior surface, between the outlet port and a lower end of the ball retaining area.

30. An apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; a die in the long bore between the upper end and the outlet port, the die being substantially immovable within the long bore and having an inner open diameter in which a plug is landable to create a seal in the long bore before passing through the inner open diameter; and at least one upper sealing member above the outlet port and at least one lower sealing member below the outlet port.

31. The apparatus as in claim 30, wherein the upper end is formed so that fluid is communicable between the surface and a target formation.

32. The apparatus as in claim 30, wherein the lower end has a pressure port to permit fluid communication from the well bore to a cavity.

33. The apparatus as in claim 32, wherein the cavity contains a pressure sensor and pressure recorder.

34. The apparatus as in claim 30, wherein the at least upper one sealing member and the at least one lower sealing member are elastomeric.

35. The apparatus as in claim 34, wherein the at least one upper sealing member and the at least one lower sealing member are cup packers.

36. The apparatus as in claim 30, wherein the plug forms a seal within the inner open diameter to prevent the flow of fluids from above the die to below the die.

37. The apparatus as in claim 30, wherein the plug is deformable by increased well bore pressure and the plug is passable through the inner open diameter thereby permitting the flow of fluids from above the die to below the die.

38. The apparatus as in claim 30, wherein the die includes an inner diameter, defined by an upper tapering section and a lower tapering section, the upper tapering section having a tapering angle, relative to a center axis, greater than a tapering angle of the lower tapering section.

39. The apparatus as in claim 30, wherein the die is formed on a replaceable component, that is insertable into the long bore.

40. The apparatus as in claim 30, further comprising a plug retaining area, in communication with the long bore, extending away from the die, beyond the outlet port.

41. The apparatus as in claim 40, further comprising a pressure-bleed off port providing communication between the ball retaining area and the exterior surface, between the outlet port and a lower end of the ball retaining area.

42. The apparatus as in claim 30, wherein the die is formed of deformable materials.

43. An apparatus for wellbore fluid treatment, comprising: a body with a lower end, an upper end, an exterior surface and an interior surface defining a long bore open at the upper end; an outlet port spaced from the upper end, the outlet port permitting the communication of fluids between the long bore and the exterior surface; a die in the long bore between the upper end and the outlet port, the die being substantially immovable within the long bore and having an inner open diameter in which a plug is landable to create a seal in the long bore before passing through the inner open diameter; and a plug retaining area, in communication with the long bore, extending away from the die, beyond the outlet port.

44. The apparatus as in claim 43, wherein the upper end is formed so that fluid is communicable between the surface and a target formation.

45. The apparatus as in claim 43, wherein the lower end has a pressure port to permit fluid communication from the well bore to a cavity.

46. The apparatus as in claim 45, wherein the cavity contains a pressure sensor and pressure recorder.

47. The apparatus as in claim 43, further comprising at least one upper sealing member above the outlet port and at least one lower sealing member below the outlet port.

48. The apparatus as in claim 47, wherein the at least upper one sealing member and the at least one lower sealing member are elastomeric.

49. The apparatus as in claim 48, wherein the at least one upper sealing member and the at least one lower sealing member are cup packers.

50. The apparatus as in claim 43, wherein the plug forms a seal within the inner open diameter to prevent the flow of fluids from above the die to below the die.

51. The apparatus as in claim 43, wherein the plug is deformable by increased well bore pressure and the plug is passable through the inner open diameter thereby permitting the flow of fluids from above the die to below the die.

52. The apparatus as in claim 43, wherein the die includes an inner diameter, defined by an upper tapering section and a lower tapering section, the upper tapering section having a tapering angle, relative to a center axis, greater than a tapering angle of the lower tapering section.

53. The apparatus as in claim 43, wherein the die is formed on a replaceable component that is insertable into the long bore.

54. The apparatus as in claim 43, further comprising a pressure-bleed off port providing communication between the ball retaining area and the exterior surface, between the outlet port and a lower end of the ball retaining area.

55. The apparatus as in claim 43, wherein the die is formed of deformable materials.

* * * * *